US005207376A

United States Patent [19]

Cohen et al.

[11] Patent Number: 5,207,376

[45] Date of Patent: May 4, 1993

[54] FOLDABLE CONTAINER AND METHOD FOR MAKING THE SAME

[75] Inventors: Laura L. Cohen, Akron; Roy M. Kay, Montville, both of Ohio

[73] Assignee: Flatwrap, Inc., Akron, Ohio

[21] Appl. No.: 670,055

[22] Filed: Mar. 15, 1991

Related U.S. Application Data

[63] Continuation-in-part of Ser. No. 357,033, May 25, 1989, Pat. No. 5,033,668.

[51] Int. Cl.[5] ..... B65D 5/24

[52] U.S. Cl. ..... 229/186; 229/8

[58] Field of Search ..... 229/186, DIG. 9, 189, 229/125.39, 8; 206/457, 459

[56] References Cited

U.S. PATENT DOCUMENTS

| | | | |
|---|---|---|---|
| 1,687,678 | 10/1928 | Mallory | 229/186 |
| 1,760,106 | 5/1930 | Beach | 229/40 |
| 1,833,492 | 11/1931 | Miller | 229/186 |
| 3,027,060 | 3/1962 | Beder | 229/8 |
| 3,627,541 | 12/1971 | Farquhar | 229/40 |
| 3,905,544 | 9/1975 | Tipton | 229/186 |
| 3,913,823 | 10/1975 | Lin | 229/186 |
| 4,332,345 | 6/1982 | Moran | 229/DIG. 9 |
| 4,333,602 | 6/1982 | Geschwender | 229/125.39 |
| 4,341,340 | 7/1982 | Lisiecki | 229/DIG. 9 |
| 4,361,236 | 11/1982 | Lavery | 229/186 |
| 4,465,227 | 8/1984 | Hood et al. | 229/186 |
| 4,648,548 | 3/1987 | Shin | 229/8 |
| 4,712,726 | 12/1987 | Fonas | 229/8 |
| 5,033,668 | 7/1991 | Cohen et al. | 229/186 |

*Primary Examiner*—Allan N. Shoap
*Assistant Examiner*—Christopher McDonald
*Attorney, Agent, or Firm*—Oldham, Oldham & Wilson, Co.

[57] ABSTRACT

The invention relates to a container which is folded from a flat blank of material being provided with a plurality of fold lines. The side walls are coupled to one another by bellows-type coupling members which are adapted to be inwardly folded during assembly to draw up the adjacent side walls to which they are attached. The top walls are dimensioned such that upon folding into substantially parallel relationship with the bottom wall it will form a closed container which is especially suitable to be used as a gift box. A portion of the bellows-type coupling member may be non-structurally adhered to a side wall of the container acting to greatly enhance subsequent folding and assembling of the container into its finished form. Predetermined fold lines may be pre-folded to allow more convenient assembly and still allow shipping in the flat form if desired. The top walls of the container may be constructed to allow a plurality of blanks to be interlocked with one another to allow very tight packing of a large number of blanks on a given sheet of material. The container may have graphics on one or both sides. The container may also be formed with punch-outs to provide an interactive container being usable as a container and subsequently forming a toy, game or having other distinct and appealing characteristics.

15 Claims, 6 Drawing Sheets

FOLDABLE CONTAINER AND METHOD FOR MAKING THE SAME

BACKGROUND OF THE INVENTION

This application is a continuation-in-part of copending U.S. patent application Ser. No. 357,033, filed on May 25, 1989, now U.S. Pat. No. 5,533,668.

This invention generally relates to an improved container constructed by folding a flat blank to form a decorative or non-decorative container assembly having unique appearance and advantages. In particular, the container of the invention is quickly and easily formed into a finished box enclosure from an initially partially folded or non-folded flat blank of material. The invention provides a simple yet durable container construction which is cost effective and may be advantageously printed or decorated by a variety of techniques to yield an aesthetically pleasing appearance and construction.

There are known in the prior art a variety of containers, such as the conventional cardboard box or two piece gift box constructions. The standard cardboard box may be constructed but is usually formed in a rolled construction such that two sides thereof are secured to one another and the formed tubular type construction may be folded to a flat position for shipping and handling until use. These cardboard containers are usually used for shipping purposes and must be made of a thick, strong material. The boxes are normally stored in a folded condition which may create deterioration of the material at the fold lines and subsequent cracking or tearing of such material due to the thickness thereof. For use, the ends of the box must be folded inwardly and taped or stapled to one another. Other container constructions include gift boxes such as the typical two-piece shirt box normally referred to as a Beirs box or Simplex box. These containers require the construction and assembly of two separate pieces, and may require structural gluing and relatively complex hand folding techniques in their construction. The two piece constructions require increased machine time, storage area and are complex to print with proper registration of graphic material thereon. Several examples of other types of containers may be found in U.S. Pat. Nos. 3,373,922 and 2,563,619 showing containers particularly constructed for holding and serving food type products. In U.S. Pat. No. 3,373,922, the construction of the container requires initial preassembly by folding sides of the container to their erect positions such that closure tabs may be structurally glued to an adjacent side wall. The preassembled container may then be folded to a somewhat flat position, similar to that of a common card board box or the like. It is noted that in the construction of the container there are necessarily formed closure tabs, inserts or hooks which must be painstakingly physically coupled with each other, or may be structurally glued or the like.

It should be recognized that the provision of closure tabs, inserts or the like which are used in construction of the finished container, make assembly thereof much more complicated and time consuming. Additionally, complicated folding techniques may be required which hinders use of the container. Another container is seen in U.S. Pat. No. 4,809,907, wherein a blank of material includes a large number of fold lines to form reinforced sides and bottom areas as well as a top portion which includes engaging tabs to secure the top portion with the container. It should be recognized that the construction of this container requires a multitude of folds to be formed for proper functioning which makes use thereof somewhat inconvenient and cumbersome.

SUMMARY OF THE INVENTION

Based on the foregoing, there has been found a need to provide a container assembly which may be easily and quickly folded from a single flat blank of material to form a durable and aesthetically pleasing box or container. It is therefore a main object of the invention to provide a container which is formed from a single flat blank of material so as to make manufacture, shipping and handling easy, efficient and cost effective, wherein the container may be quickly and easily folded to an assembled, usable position.

It is yet another object of the invention to provide a container which may be constructed of a relatively light weight paper material. A lightweight paper material allows fine precision folding and yet will provide a strong and durable container construction. Such a paper material may be easily and conveniently printed on one or both sides thereof with high quality and conventional printing techniques such as offset, Gravure or the like.

Another object of the invention is to provide a container which may have no integral closure means, and is thus simplified in construction and use, wherein an adhesive label or other closure means may be conveniently packaged directly with the container during the manufacture for subsequent use to secure the container. Alternatively, an adhesive tab or other suitable closure means may be provided in association with top wall members of the container to affect closure thereof.

Another object of the invention is to provide a container which is pre-folded in a desired manner so as to remain in an essentially flat condition for shipping and handling, but also allows the container to be constructed in an extremely quick and easy manner.

It is another object of the invention to provide a container which may be pre-folded to a selected position to greatly facilitate assembly.

Yet another object of the invention is to provide a container having a construction wherein a plurality of fold lines are incorporated into the flat blank of material to allow various aspects of the invention to be achieved. For example, various fold lines formed in the flat blank of material are adapted to facilitate the pre-folding of the container or subsequent assembly of the container, as well as to reduce surface cracking of graphic material printed on the surfaces of the container or deterioration of the container material.

Another object of the invention is to provide a container which may be efficiently and cost effectively manufactured in an in-line process, wherein all steps necessary to produce a partially pre-folded container ready for shipping, handling and subsequent construction are produced in a continuous process which may utilize either sheet fed or web fed paper or other material.

Yet another object of the invention is to provide a container which is constructed to greatly reduce the amount of waste or scrap material generated during production of a plurality of such containers from a flat sheet or web of material. The construction of the container allows a plurality of containers to be tightly packed or nested onto a given flat surface, wherein a common rule used for die cutting is shared by a plurality of container blanks.

Still another object of the invention is to provide an interactive container or box which may have a variety of punch-out or pop-out forms produced therein, which pieces may act as a toy, game piece or other functional device. For example, the container may be provided with graphic media forming a game board, wherein a variety of punch-outs having different graphic material thereon may then be used as game pieces or the like. Alternatively, punch-outs may be formed to interact with one another to form a functional toy such as a paper airplane, paper doll or the like. The container may also be provided with partial punch-outs to achieve various visual effects or cut regions which allow an interactive card to be used with the container, wherein the card interacts with the graphics formed on the container.

It is a further object of the invention to provide a container wherein portions thereof may allow the container to have a variable size volume to accommodate different sized articles therein.

It is another object of the invention to provide a unique die assembly and method of making the container, which may include pre-folding thereof to a selected position for shipping and handling and to enhance subsequent construction of the container into its finished form.

The container of the invention comprises a bottom wall with four side walls positioned therearound. A plurality of top walls which act in conjunction with one another to completely close the container are provided adjacent each side wall thereof. The container is formed from a unitary blank of material such as a light weight paper, which may be printed thereon to provide a graphic material on either one or both sides thereof. The first and third side walls of the container are diametrically opposed and have disposed on their outer peripheral edges a top wall which extends over approximately half of the top surface of the assembled container. The second and fourth side walls include top walls formed on the outer peripheral edges which may extend over slightly half of the top surface so as to overlap one another. The top walls may be configured such that all four top wall members are exposed at approximately the center of the top surface to be secured by any appropriate means, such as a separate adhesive label or integral adhesive tab.

The container also contains bellows-type coupling members connecting each of the respective side walls thereof. The coupling members include a fold line positioned to allow inward folding of the coupling member toward the interior of the container so as to draw the respective side walls to an upstanding position relative to the bottom wall. A portion of the bellows-type coupling member may be non-structurally adhered to a side wall of the container acting to greatly enhance subsequent folding and assembly of the container into its finished form. The adherence of a portion of the bellows-type coupling member does not provide necessary structural features in the construction, and therefore is termed non-structural, although providing significant advantages in assembly of the container. The bellows-type coupling members may also provide a variable volume container depending upon their orientation within the container when assembled. Each of the walls of the container are separated from an adjacent wall by a fold line which allows the container to be quickly and easily assembled into a box-like form. Predetermined fold lines may be pre-folded to allow more convenient assembly, while still enabling packaging and handling while in a substantially flat form as desired. Various fold lines are adapted to facilitate pre-folding of the blank of material as desired, while others are adapted to allow quicker and easier folding into an assembled condition and easy access to the interior of the assembled container. The container may also have diagonally cut top walls which allow very tight nesting of a large number of container blanks during manufacture from a sheet or continuous web of material.

The container is extremely advantageous in that only one blank of material is used in its construction which reduces the material requirements and greatly facilitates printing and handling operations. During manufacture, the container may also be formed with punch-outs to provide an interactive container being usable as a container and subsequently forming a toy, game or having other distinct and appealing characteristics. The container is especially suitable for use as a gift box of variable size wherein graphic material may be easily and effectively printed thereon to yield an aesthetically pleasing and decorative appearance similar to a gift-wrapped package which would eliminate the need for the use of wrapping paper or the like.

BRIEF DESCRIPTION OF THE DRAWINGS

These and other objects, advantages and uses of the invention will become apparent from a reading of the following detailed description with reference to the accompanying drawings wherein.

DETAILED DESCRIPTION OF THE INVENTION

Figure 1:
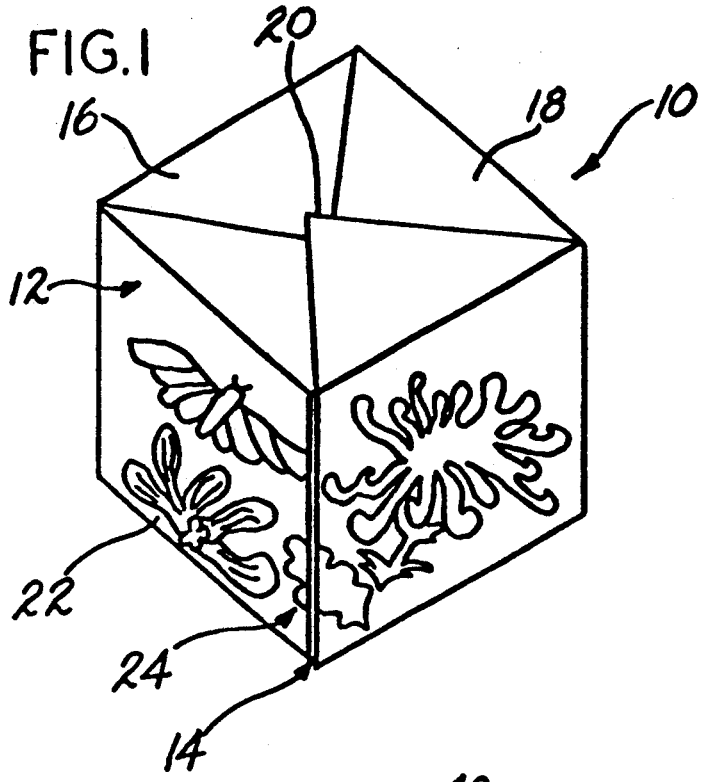
FIG. 1 is a perspective view of a first embodiment of the assembled container of the invention.

Turning now to FIG. 1, the container 10 is shown in its constructed form to fully enclose an item such as a gift or the like. The container 10 includes four side walls 12 which surround a bottom wall of the container. The side walls 12 lie adjacent one another at the edges thereof when in their upstanding position relative to the bottom wall, to form a joint 14 similar to a miter joint. The joint 14 gives a clean aesthetically appealing creased edge look similar to those formed utilizing wrapping paper or the like. The container 10 also includes top wall members including two pair of opposed top walls 16 and 18 which are folded to form a completely enclosed top wall for the container 10. The pair of opposing top walls 16 may be constructed so as to overlap slightly at 20, and the pair of opposing top walls 18 may be adapted to cover approximately half of the top wall. The pair of opposing top walls 16 may be configured such that all four top walls comprising pairs 16 and 18 will be exposed at approximately the center of the container 10. The top walls may be secured in the closed position as seen in FIG. 1 by any suitable means as desired. In one aspect of the invention, the container does not include any integral closure means to secure the top walls in their closed position, and may include a separate adhesive label or the like which is positioned so as to secure each of the top walls in their closed positions at their exposed regions near the center of the container. In this regard, the use of gluing, tabs, inserts or the like to secure the side walls or top walls of the container is avoided. Such internal closure means may necessitate the use of additional equipment and/or increase the time and effort needed to construct the container. The container 10 of the invention in one embodiment recognizes that conventionally there will be provided other means by which the container may be secured without providing tabs, inserts or the like. The container 10 may therefore make use of separate means by which the container may be secured from opening, such as a decorative bow, ribbon, adhesive label or merely a piece of adhesive tape. The container 10 in such an embodiment will not include securing means which add to the complexity and cost of the construction.

As seen in FIG. 1, the side walls 12 or any of the surfaces of the container 10 may include graphic material 22, which may be printed material, wherein such printing may be formed on the container 10 by any conventional printing technique. Such printing techniques include embossing, hot stamping, foil stamping, thermography, offset, gravure printing and other conventional techniques. For example, the interior of the container 10 may be provided with a printed greeting card, advertisement or the like, wherein the final presentation container formed by the blank 30 may be utilized as a gift package having a card appropriate for the occasion printed right on the container for convenience and adaptability of use.

The graphic material 22 on the container in conjunction with its construction may allow the container 10 to act as a final presentation gift box or the like, which may be used to house a gift without requiring the additional use of wrapping paper or the like. The ability to print any desired material on the surfaces of the container 10 and the ability to use any conventional printing technique, wherein high quality printing may be achieved, may preclude the use of a wrapping paper. It is noted that the graphic material 22 may have been advantageously printed on the sides or other portions of the container 10, such that a wrap-around effect is accomplished by the printing as seen at 24 when the container is assembled. The joints 14 form a mechanical reproduction of the fold utilized with a fine hand-wrapped package using wrapping paper, to yield a very aesthetically pleasing appearance without wasting time or effort with further wrapping as conventionally done in the past.

Figure 2:
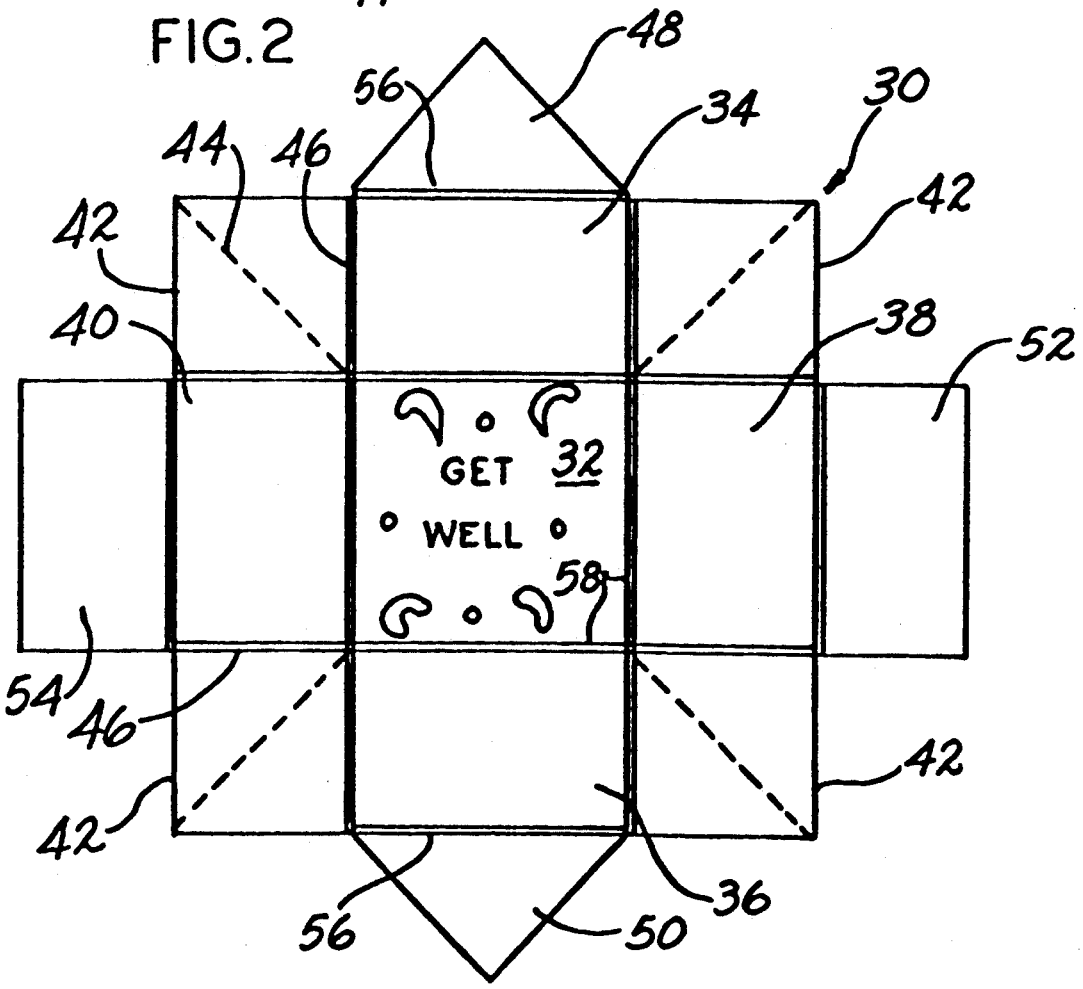
FIG. 2 is a top plan view of a blank of material which may be used to form the embodiment of the container as illustrated in FIG. 1.

The container 10 as seen in FIG. 1 is constructed from a flat blank 30 of material as seen in FIG. 2. A bottom wall 32 is surrounded by first and third side walls 34 and 36 diametrically opposed about the bottom wall 32, as well as second and fourth side walls 38 and 40 also in diametrically opposed positions. The side wall members 34–40 are coupled together by means of bellows-type coupling members 42 which will draw the respective side walls 34–40 to a closely adjacent position to form the joints 14 as seen in FIG. 1. The bellows-type coupling members 42 include a fold line 44 therein, such that they may be easily creased inwardly during assembly of the container. The coupling members 42 are also connected to each of the adjacent side walls by means of fold lines 46. In this embodiment of the invention, the first and third side walls 34 and 36 are coupled with top wall members 48 and 50, and the second and fourth side walls 38 and 40 are coupled with top walls 52 and 54 respectively. At the interface of the top wall members 48–54 with the side walls 34–40, there are provided fold lines 56 enabling the top wall members 48–54 to be folded into a closed position at the top of the container during assembly, being substantially parallel to the bottom wall 32.

In an embodiment of the invention, several combined die techniques are utilized to form the fold lines in the flat blank of material 30, to enable proper folding and construction of the container. For example, scoring techniques different die matrices may be utilized to provide the proper amount of scoring at the desired thickness to enable proper positioning of the respective side and top walls relative to one another as well as to achieve sharp precision folds along each of the fold lines. It should be recognized that the top walls must fit very precisely relative to the side walls to form the aesthetically pleasing joint 14 as seen in FIG. 1, as well as to form a tightly closed container as desired. The particular scoring techniques of the invention also reduce or eliminate any cracking or degradation of the container material or graphics printed on the container 10, especially at the location of the corners or fold lines thereof.

As will be described in more detail hereinafter, the manufacture of the container 10 from the blank 30 to form a final presentation container is particularly adaptable to an in-line process. For example, a continuous web of a stock paper material may be printed on one or both sides thereof using conventional printing techniques. As the continuous manufacturing process progresses, the printed web of paper material may subsequently be die cut utilizing a manufacturing die to form a plurality of flat blanks from which a plurality of containers may be constructed. In association with die cutting of the individual blanks from the continuous web of paper material, each of the blanks may be provided with the proper fold lines by means of scoring, perforating or other techniques. It is of particular importance that the graphic material which may be provided on one or both surfaces of the blank 30 be registered with respect to individual fold lines or edges of the blank 30, such that when the container 10 is constructed from the blank 30, any graphic material will be positioned in the proper and desired location on the surfaces of the formed container 10. The container 10 and method of construction allow graphic material to be registered in precise position and orientation with respect to any of the fold lines formed in the flat blank 30 very accurately and reliably. The container may therefore include detailed and intricate graphic material which is reproducible in a large plurality of containers formed in the in-line manufacturing process. Better graphics may therefore may be obtained resulting in a higher quality appearance which allows use of the container as a gift box which does not require wrapping paper or the like to be used therewith. It should also be recognized that the container 10 is formed from a single, integral flat blank of material 30, such that the steps in manufacturing require cutting and printing of only one piece of material rather than the two pieces conventionally used in known gift boxes. The flat blanks of material formed in the manufacturing process may be subsequently packaged and shipped in their flat position, so as to ease handling and distribution thereof.

The container 10 of the invention may be constructed from a variety of materials, but the construction is particularly applicable for paper materials of various weights and grades. Particularly, the construction of the container may be advantageously formed from relatively light weight paper materials to reduce cost of manufacture, and also to facilitate easy construction thereof and enhance the ability to effectively print any graphic material thereon. For example, an eighteen point paper sheet material may be utilized which is significantly lighter than other conventional gift box constructions. Although light weight paper materials may be effectively utilized, the construction of the container is still strong and durable for its intended use. The construction of the container including bellows-type coupling members 42 allows reinforcement of the corners of the formed container, and may reinforce the top wall members thereof, such that a very strong and yet light weight construction results. Alternatively, the weight of the paperboard may be increased to match the paper weight of other conventional gift boxes, or may be increased to substantially increase the strength and durability thereof. The preferred paper weights used to construct the container of the invention will generally fall between a gift wrap material and a conventional thick cardboard material, but again may use any of a variety of materials or thicknesses as desired. The construction of the container also allows a broad range of off-line customization including additional printing or other off-line processes conveniently and cost effectively.

It is also a feature of the invention that the container 10 may be ergonomically designed in accordance with the parameters of the users. In one embodiment, the container 10 may be constructed to be the size of a smaller gift box which conforms generally to the size of an average hand span of the user. The design of the container in such an embodiment accommodates the natural tendency to fold the fingers of the hand to the center of the hand in a grasping motion. During assembly, the bellows-type coupling members 42 are folded inwardly be means of the thumb and little finger of each hand on respective sides of the container leaving the three middle fingers and palms of the hands to fold in the side walls adjacent thereto with the coupling elements 42 drawing each side wall upwardly therewith. The natural tendency of the grasping motion is utilized to easily fold and construct the container of the invention.

Figure 3:
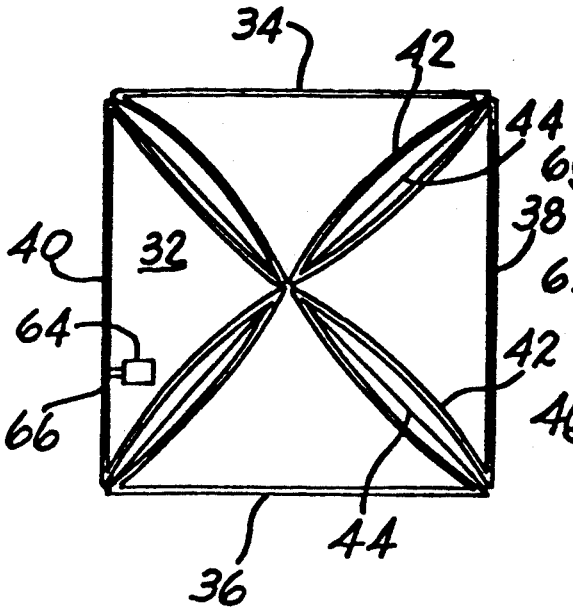
FIGS. 3 and 3*a* show top plan views of the container in its assembled condition with the top walls open showing positions of the bellows-type coupling members on the interior of the container.
Figure 3A:
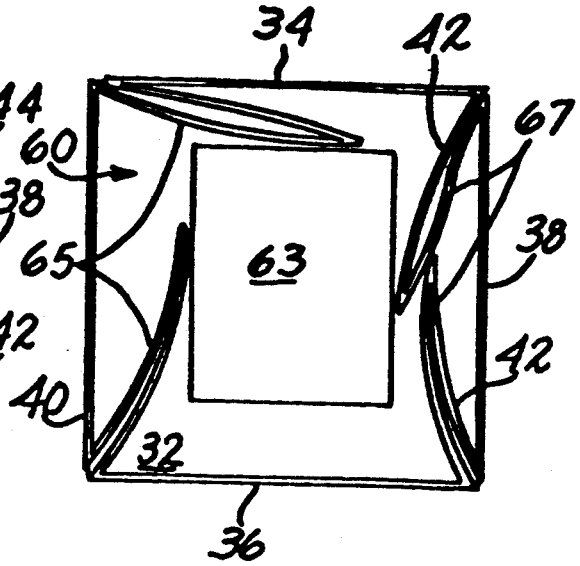
Figure 4:
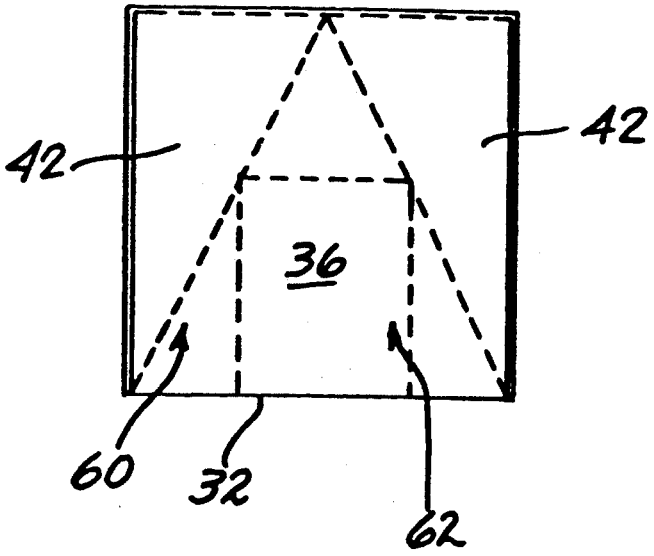
FIG. 4 is a side view of the container showing the position of the bellows-type coupling members within the container as seen in FIG. 3.

Turning now to FIGS. 3, 3*a* and 4, other advantages of the container will become apparent. As seen in FIG. 3, wherein like elements are referenced in accordance with FIG. 2, the side walls 34–40 are folded into an upright position around the bottom wall 32. The bellows-type coupling members 42 having fold lines 44 therein, are inwardly folded along fold line 44 to the interior of the space enclosed by side walls 34–40 as shown. The bellows-type coupling members 42 will generally act to provide further support for the top walls of the construction and will strengthen the corners of the formed container 10. In another aspect, the bellows-type coupling members 42 may extend toward the center of the container, and may act to center a smaller sized item 62 in the container for storage. The bellows-type coupling members 42 also reinforce the side and top walls of the assembled container to allow effective storage without the threat of damaging or crushing the top or side walls of the container.

It is also a feature of the container assembly that a musical chip 64 activated by an extending post or switch 66 may be placed in the container during manufacture. The musical chip 64 may be positioned on bottom wall 32, wherein the switch 66 will be closed when a side wall of the container is moved to its upright position during assembly of the container. When the container is subsequently opened, the switch 66 will be released to initiate the playing of a melody programmed into chip 64. The chip may be similar to that used in musical greeting cards and the like.

It should also be recognized, as seen in FIG. 3*a*, that the bellows-type coupling members 42 may act to vary the effective storage volume 60 of the container, as well as providing means acting to center an object within the container. Thus, when an item 63 which has dimensions smaller than the container is placed into the container, the coupling members 42 may act to retain the item 63 in a centered position within the container by means of their inwardly extending orientation. The coupling members 42 may thereby protect an item placed in container 10 by avoiding movement thereof within the container. As the size of an item to be stored in the container increases, the coupling members 42 may be physically moved to a position more closely adjacent one of the side walls of the container 10. The positions of the coupling members 42 may be on each side of the item 63 as at 65, or may act together on a side of the item 63 as shown at 67, while still providing the protection against movement of the item 63 within container 10. Thus, the container of the invention may allow variable sized items to be effectively positioned and protected within the container. The bellows-type coupling members 42 may essentially allow a variable volume to be achieved depending upon the orientation of coupling elements 42 on the interior of the container. In the various orientations of coupling members 42, each of the coupling members will still act to provide additional support to the top and side walls, so as to maintain the desired structural strength of the container 10.

Figure 5:
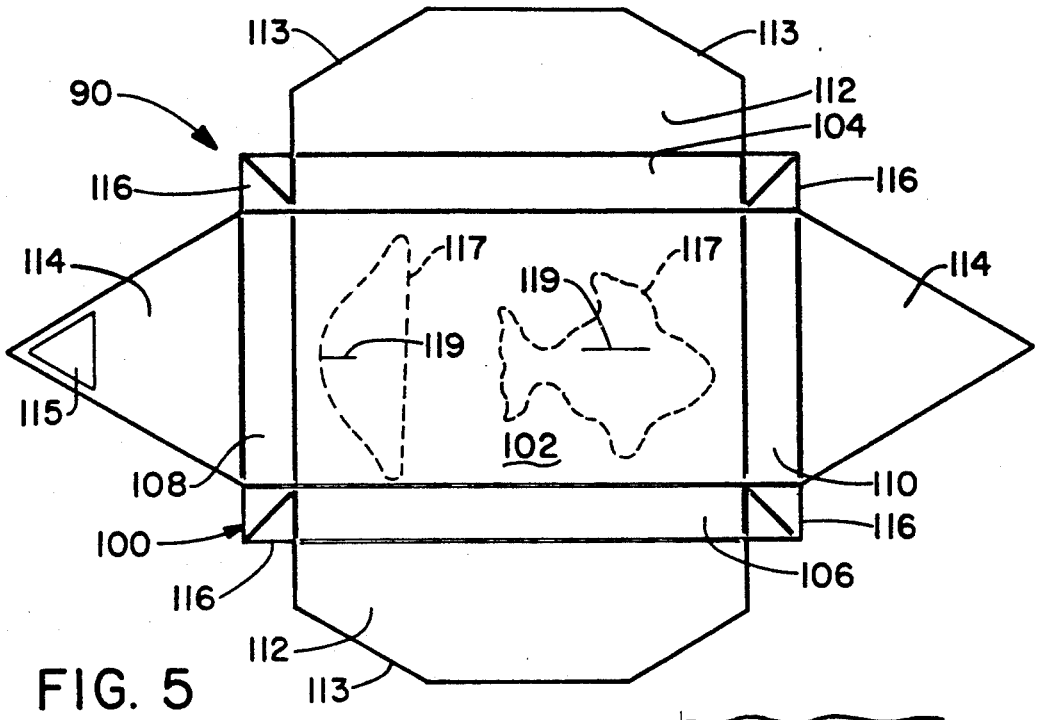
FIG. 5 is a top plan view of an alternate embodiment of the container, having dimensions similar to a shirt box conventionally used as a gift box.

Turning now to FIG. 5, an alternate embodiment of the invention is shown. The container 90 shown in FIG. 5 may be sized similar to a conventional shirt box or the like conventionally used as a gift box for larger items. The container 90 may be formed from a flat blank of material 100, wherein some of the construction of container 90 is basically similar to that described with reference to the embodiment of FIG. 1. Again, the container 90 formed from the flat blank 100 includes a bottom wall 102 surrounded by side walls including first and third side walls 104 and 106 which extend the length of bottom wall 102. The side walls 104 and 106 are coupled to the bottom wall 102 by fold lines which allow the side walls to be folded into an upright, substantially perpendicular position with respect to bottom wall 102. The side walls 104 and 106 are also coupled to top walls 112 by another fold line, wherein the top walls 112 may be folded to a substantially parallel position with respect to bottom wall 102 to enclose the container 90. The top walls 112 may have dimensions so as to extend over approximately half of the width of the bottom wall 102. It is also noted that the top walls 112 may be formed in a rectilinear shape wherein outer corners thereof diagonally cut as seen at 113 forming pre-selected angled portions thereon to greatly facilitate manufacture of a plurality of containers in a nested configuration from a flat sheet of material as will be hereinafter described.

The container 90 also includes second and fourth side or end walls 108 and 110 which extend the width of the bottom wall 102 and are coupled therewith by means of a fold line to allow side walls 108 and 110 to be folded to an upright substantially perpendicular position relative to bottom wall 102. As previously described, the side walls are coupled to one another by means of bellows-type coupling members 116 which include a fold line bisecting coupling members 116 similar to that previously described. The bellows-type coupling members 116 will be folded inwardly along the fold line formed therein to draw up the respective side walls to which they are attached, and again provide reinforcement for the corners of the assembled container and additional support for the top and side walls adjacent thereto. It should be recognized that this same basic construction can be utilized with other size containers, and any size container may be provided for as desired. Top wall members 114 are coupled to the outer edges of the side walls 108 and 110 by means of a fold line to allow top walls 114 to be folded to a substantially parallel position relative to bottom wall 102. The top wall members 114 may be triangularly shaped and dimensioned so as to extend slightly over half of the length of bottom wall 102 to allow slight overlap of the top walls 114 when folded to their assembled position. The top wall members 114 will be folded on top of top walls 112 in the assembled container, such that all four top wall members may be exposed at approximately the center of container 90 similar to that previously described. One of the top walls 114 may be provided with an adhesive tab 115 or the like, which may be used to secure the two top walls 114 to one another, as well as to top walls 112 if desired. In the assembled condition, the top walls 114 also act to provide a pulling force from the side walls 108 and 110, wherein upon securing top walls 114 upon assembly of the container, this force acts to maintain the position of all wall members of the container to form a secure and strong construction. In this embodiment, the fold lines coupling the top walls 112 and 114 may be formed as hinged score lines which allow the top walls to easily collapse both inwardly to their enclosing position as well as outwardly to make the interior of the container readily accessible. The hinge score allows the top walls to be folded or to fall both directions relative to the respective side walls without degradation of the fold line or container material. Although the top walls 112 and 114 have been described relative to a preferred embodiment, it should be recognized that the particular shape or dimensions may vary without substantially affecting the performance thereof.

In the embodiment of FIG. 5, it is also noted that the container 90 may have formed therein various punch-out or pop-out forms 117, which as seen in FIG. 5 may comprise the form of a fish and wings wherein these forms may be punched from the container assembly and be themselves assembled into a flying fish toy. The forms 117 may additionally comprise slit regions 119 which facilitate assembly of the various forms together in a conventional manner. It should be recognized that a wide variety of various forms may be simply provided in the construction of the flat blank 100 during the manufacturing process. To achieve the punch-out configuration, the forms may be generated using a perforating rule, wherein the structural integrity of the material is maintained until a sufficient force is directed against the perforated region. The container 90 may thereby form an interactive container or box which may have a variety of punch-out or pop-out forms produced therein, wherein the punch-out forms may act as a toy or alternatively as a game piece of other functional device. For example, the container may be provided with graphic media forming a game board, wherein a variety of punch-outs having different graphic material thereon may then be used as game pieces, cards or the like. It is also contemplated that the interactive container may contain partial punch-outs to achieve various visual affects, wherein the partially punched-out form will produce a raised surface or the like on the container. It is also contemplated that the container 90 may be formed with appropriate slits therein which are adapted to accept and retain a card to be associated with the container, wherein the gift card may be provided with graphics which interact with the graphics generated on the container itself. The container may also include various punch-out portions which act as stands for various other punch-out forms so as to create a three dimensional toy or the like.

Figure 6:
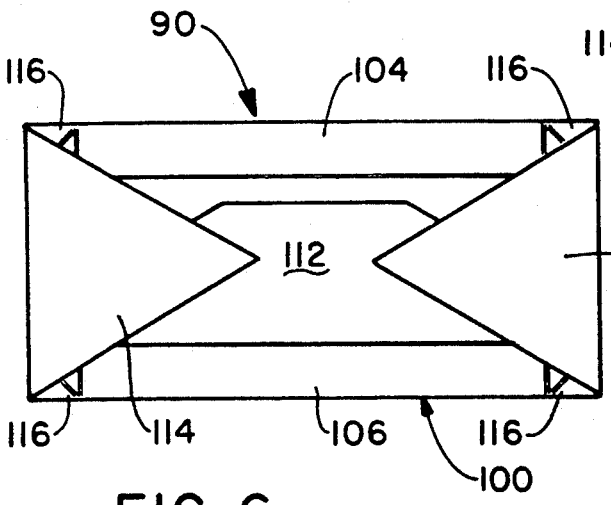
FIG. 6 is a top plan view of the container as shown in FIG. 5 in a pre-folded position to facilitate packaging, handling and subsequent assembly of the container.

In an alternate construction of the container 90, it has been found to be particularly advantageous to pre-fold the flat blank of material 100 along pre-selected fold lines formed therein, to greatly enhance subsequent assembly of the container. In a preferred embodiment, the flat blank of material 100 is pre-folded to the configuration as seen in FIG. 6. In the pre-folded configuration, various of the side and top walls of the container 90 are folded so as to lie upon the bottom wall 102 or one another. Various of the folds made to form the pre-folded configuration as seen in FIG. 6 are the folds which would be made to assemble the container 90 from the flat blank of material 100, and therefore will greatly enhance subsequent assembly of the container for use as will be hereinafter described. Additionally, the pre-folded configuration maintains the substantially flat configuration of the container 90, and reduces the size of the container for handling and shipping thereof. In production, a large number of flat blanks may be provided with the desired fold lines therein and cut from a discrete or continuous sheet of material, after which automatic folding equipment may be used to quickly and efficiently fold the flat blank into the configuration as seen in FIG. 6. A large number of pre-folded containers may then be stacked in their flat condition and packaged utilizing shrinkwrap or any other conventional packaging techniques. The ability to package a large number of pre-folded containers using shrinkwrap packaging or the like, greatly facilitates handling and storage of the packaged containers in convenient numbers to be easily used in retail environments. It is also noted that the manufacturing process may be automated from beginning to end to yield an extremely cost effective container assembly.

Turning now to FIGS. *7a–7d*, the pre-folding of the flat blank of material 100 to the configuration as seen in FIG. 6 will be described along with an alternative embodiment of the invention which enhances subsequent assembly of the container for use. In FIG. 7, the flat blank of material 100 is firstly formed with the fold lines coupling each of the walls of the container to an adjacent wall as well as to the bellows-type coupling members 116 formed therein. In the automatic manufacturing process, after the flat blank 100 has been printed on one or both sides thereof, formed with the appropriate fold lines and die cut from a sheet of material, there may be dropped onto the bottom wall 102 a greeting card 118 and adhesive label 120 if desired. It has been found in the automatic manufacturing process that the paper material from which the flat blank 100 is preferably constructed, will build up a static electricity charge which will facilitate maintaining the card 118 and adhesive label 120 on the bottom wall 102 during production.

In an alternate embodiment of the invention, a minor amount of non-structural gluing may be performed which will greatly enhance subsequent assembly of the container. The non-structural gluing is performed adjacent the outer corners of the end walls 108 and 110 as shown at 122. The gluing performed in this embodiment of the invention is not similar to gluing conventionally utilized in container constructions as it is not required to structurally form the container in any manner. The gluing performed in this embodiment does not form a functional container, but is merely designed to greatly enhance and improve the speed and ease with which the container may be subsequently assembled for use. After the end walls 108 and 110 have been hit with the glue spots 122, a first side wall 104 along with top wall 112 and each of the bellows-type coupling members 116 coupled to side wall 104 are folded onto bottom panel 102 as seen in FIG. *7b*. The adherence, gluing or the like of this type is defined as non-structural for purposes of description. It should be recognized that a portion each of the bellows-type coupling members 116 will be secured to the end walls 108 and 110 respectively by means of the glue spots 122 or other suitable means provided on end walls 108 and 110. The bellows-type coupling members 116 will be secured to the end walls 108 and 110 on the portion 124 adjacent the end walls, which is separated from the remaining portion of the bellows-type coupling member 116 by means of the bisecting fold line 126 formed therein. The remaining portion of the bellows-type coupling members 116 will be free from attachment to the end walls 108 and 110. As seen in FIG. *7c*, the next step in the process of pre-folding the container 90 is to fold side wall 106, the associated top wall 112 and the bellows-type coupling members 116 similarly to that of side wall 104 and the associated structure as seen in FIG. *7b*. Again, the portions 124 of the bellows-type coupling members 116 will be secured to the end panels 108 and 110 by means of the glue spots 122 or the like as previously described. The final steps of pre-folding the container 90 are seen in FIG. *7d*, wherein each of the top walls 114 will be folded along the fold lines coupling the top walls 114 to end walls 108 and 110 respectively, so as to be folded upon bottom wall 102. After top walls 114 have been folded as indicated in FIG. *7d*, the final pre-folded configuration of FIG. 6 is achieved. In the pre-folded position, the separate greeting card 118 and adhesive label 120, if provided, will be securely maintained within the pre-folded construction until use of the container is desired. It is noted that in the pre-folded configuration, the actual dimensions of the container have been reduced to slightly larger than the bottom wall 102 of the container, while maintaining a substantially flat configuration as desired.

Turning now to FIGS. *8a–8c*, assembly of the pre-folded container 90 to its usable form will be described. Once the container has been folded to its pre-folded configuration, the two top walls 114 will extend toward the center of the container and will be exposed on the top of the flat pre-folded assembly as seen in FIG. *8a*. The top walls 114 overlie end walls 108 and 110 and the bellows-type coupling members 116 adjacent thereto. As mentioned previously, a portion of the bellows-type coupling members 116 may be non-structurally secured to the end walls 108 and 110, such that movement of the end walls 108 and 110 will in turn cause relative movement of the coupling members 116. As seen in FIG. *8b*, to assemble the container 90 from the flat pre-folded configuration as seen in FIG. *8a* simply requires the exertion of a pulling force on the ends of top walls 114 as indicated by arrows 128, or alternatively a pushing force on the ends of top walls 114 or the side walls 108 and 110 as indicated by arrows 130. Upon exerting the pulling force on top walls 114 or the pushing force to side walls 108 and 110, the bellows-type coupling members 116 will automatically begin to inwardly fold along fold line 126 and will act to draw upwardly the side walls 104 and 106 to their upstanding positions relative to bottom wall 102. Upon further application of the forces 128 or 130, the container 90 will be quickly formed into its assembled condition for use as seen in FIG. *9c*. In operation, assembly of the container 90 only requires the application of a slight pulling force to top walls 114 or a slight pushing force to the side walls 108 and 110 which will cause the bellows-type coupling members 116 to "pop" to their inwardly folded configurations. The inward folding of coupling members 116 act to immediately draw side walls 104 and 106 to their upright positions. The "popping" action of the assembly quite dramatically forms the finished usable container from the flat pre-folded configuration extremely quickly and easily. Of particular importance in attaining the "popping" action is the provision of securing the portion of the bellows-type coupling members 116 to the end walls 108 and 110 as previously described. The provision of gluing or otherwise securing the portions of the coupling members 116 in the manner described not only results in a container which is efficiently and cost effectively manufactured, handled and packaged, but also enables the container to be easily used without requiring any hand folding or other assembly operations by the user.

Figure 9:
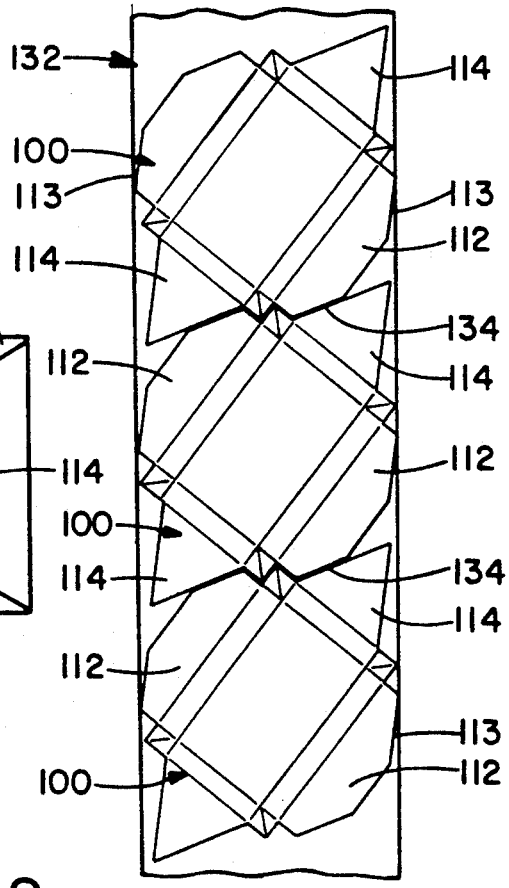
FIG. 9 is a top plan view of a plurality of foldable blanks to be produced from a paper material or the like wherein the paper material is either in sheet or continuous web form.
Figure 7A:
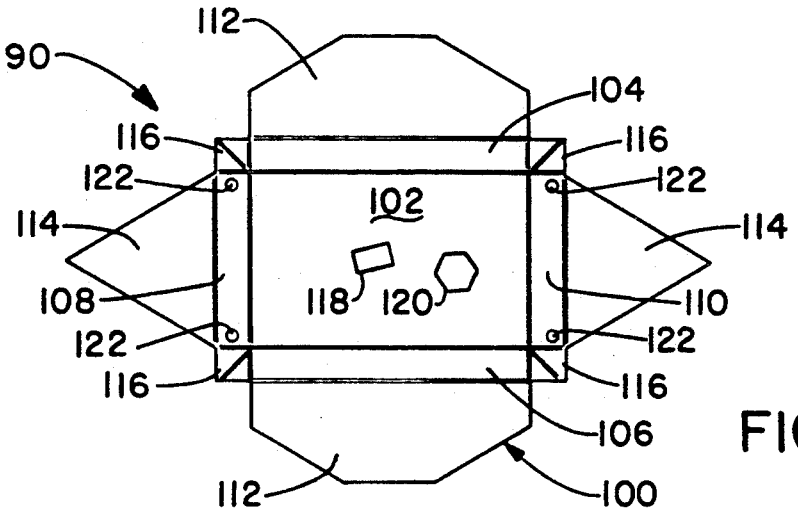
FIGS. 7*a*–7*d* are top plan views of an alternate embodiment of the container showing the steps of pre-folding the container to the position as seen in FIG. 6.
Figure 7B:
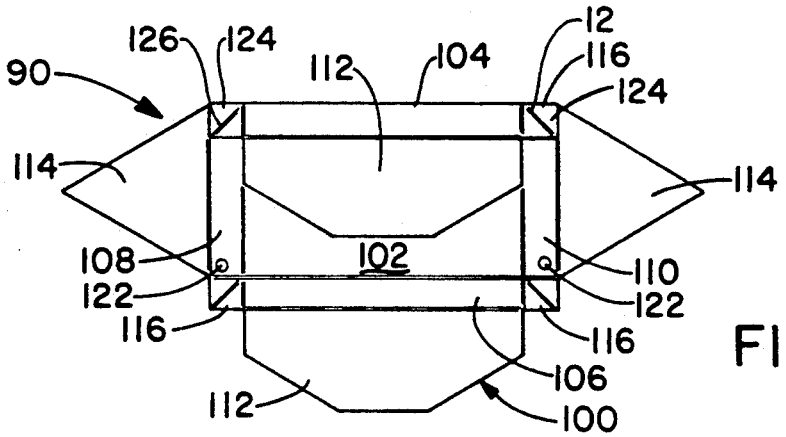
Figure 7C:
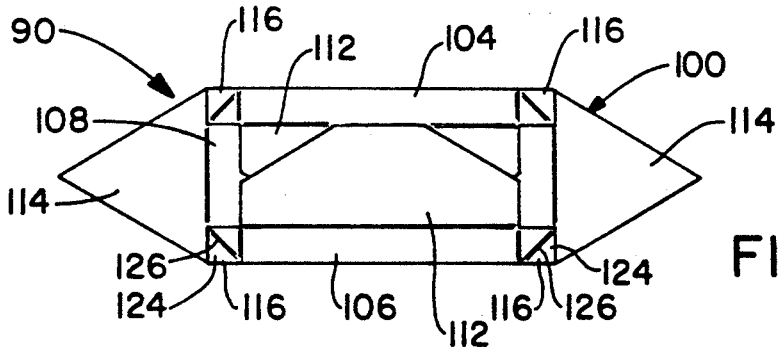
Figure 7D:
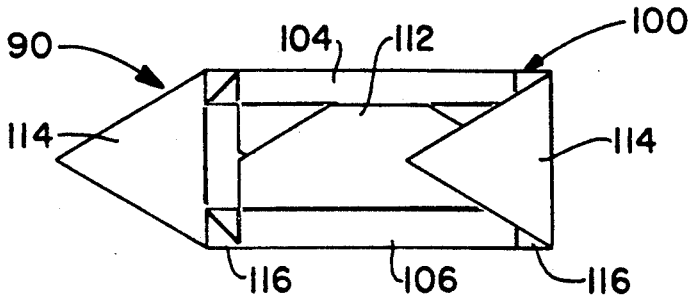
Figure 8A:
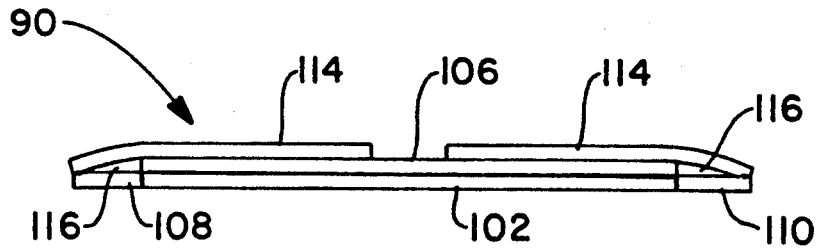
FIGS. 8*a*–8*c* are side elevational views of the container formed in the pre-folded condition and showing assembly of the container from this pre-folded position.
Figure 8B:
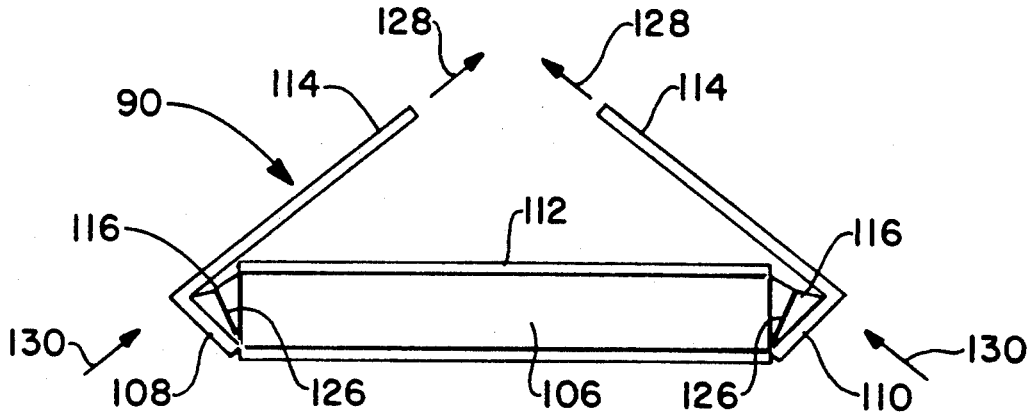
Figure 8C:
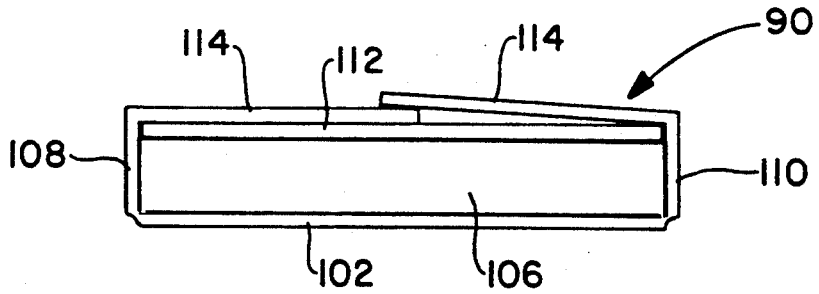

Turning now to FIG. 9, the configuration of the embodiment of the container as seen in FIG. 5 which allows for extremely cost effective and efficient manufacture is described. As previously mentioned, because the container is constructed from a flat blank of material, a large number of flat blanks may be formed from a single sheet or continuous web of material as an in-line process. When cutting a large number of flat blanks from a sheet of material, there may be produced a large quantity of scrap material, which would add to the cost of the manufacturing process. As seen in FIG. 9, a continuous web of sheet material 132 having a predetermined width may be used to form a large number of flat blanks 100 from which the container of the invention may be constructed. By providing the diagonally cut corners 113 on top walls 112 as previously described, it has been found that each of the individual blanks 100 may be die cut from the sheet 132, wherein a common rule is used for die cutting and is shared by adjacent container blanks. As seen in FIG. 9, the diagonally cut corners 113 are cut at an angle which coincides with the shape of the top wall 114, such that adjacent container blanks 100 will interlock or nest along line 134 shown in bold in FIG. 9. In this interlocking relationship, the individual blanks 100 may then be skewed or rotated relative to the width of sheet 132 so as to be tightly packed onto any given width of sheet material which is utilized. It should be recognized that additional foldable blanks 100 may be positioned adjacent one another both lengthwise of a sheet material as well as widthwise in the interlocking relationship as seen in FIG. 9. In a web processing method using roll stock, a continuous ribbon of sheet material 132 having a predetermined width will be used to form a very large number of foldable blanks 100, wherein some amount of scrap will be lost at the front and back of the roll, but very little scrap is produced along the length of the web which constitutes the majority of surface area thereof. In operation, web processing methods have resulted in only about two to three percent scrap being produced, which makes the manufacturing of the foldable blanks extremely cost effective. If a discrete sheet of material is utilized, slightly more scrap may be produced, but again scrap is greatly minimized by means of the interlocking relationship of individual foldable blanks 100 and the ability to rotate the foldable blanks 100 into a tight fitting relationship on any size of sheet material. It should also be recognized that the construction of the container uses less paper material to form the container than conventional two piece containers as there is less internal field used in the construction thereof. It has also been found that there is no need to orient the foldable blanks of material with the grain of the paper to maintain the structural integrity and folding capabilities of the container. It is also noted that any scrap areas which are produced in the manufacture of a large number of foldable blanks 100 may be used to form cards or the like which may be used in conjunction with the containers as previously described.

Turning now to the manufacturing die utilized to produce the invention, a multi-operation die 150 is provided to accomplish a variety of die operations in a single manufacturing step. The die 150 accurately produces a variety of fold lines as well as cutting of a base material to form the blanks utilized in the assembly of the container. The die 150 may include the use of various scoring operations, slitting and perforating rules as well as the application of both broad and narrow matrices. The die is in effect a double die in that it may produce a reverse series of scores needed to allow proper multiple layer folding without crushing the delicate inside corners of the container assembly, and to prevent surface cracking of graphic material along the fold lines thereof. For the embodiments of the invention, a first set of a plurality of slitting rule members 152 are provided to cut the outer peripheral edges of the foldable blank used to construct the assembled container. The slitting rule members 152 are positioned to extend a predetermined depth upon application of the die 150 so as to completely sever the blank from the base material. A series of ejection rubbers 154 may be provided for release of the die-cut material after application of the die. A second set of scoring rule members 156 may be provided to produce the scored fold lines at the coupling locations of the side and top walls of the container as well as of the bellows-type coupling members associated therewith. The scoring scoring rule elements 158 which may be provided to produce scored fold lines at the coupling locations of the side walls to the bottom walls which are increased in score size to allow quicker and easier folding of the side walls to the pre-folded configuration as seen in FIG. 6. The scoring rules 158 may also produce fold lines scored oppositely to those produced by rules 156 to accomplish these purposes. Broader rule members may also be used to form the fold lines bisecting the bellows-type coupling members of the container to form weakened zones which will allow the folding of the bellow-type coupling members as an initial step in assembly of the container. In the embodiments described, the fold line formed in the bellows-type coupling members is preferably a weakened zone which is more easily manipulated than the other fold lines, and may be provided by a broader scoring rule which will facilitate the "popping" action during assembly of the container. Alternatively, a fourth set of fine tooth perforating rules 160 may be provided to produce perforated fold lines in the bellows-type coupling members, to allow the coupling members to be readily folded inwardly for quick and easy assembly of the container. Such perforal rules 160 may also be used to form the punch-out or pop-out forms, wherein the perforations will allow easy removal of the forms but will not impair the structural integrity of the container.

The manufacturing die 150 may also include the use of matrix tape associated with all of the scoring rules 156 and 158. An example of the matrix tape is shown at 162, which allows the desired amount of scoring to be accomplished by each of the individual scoring rules. It has been found with the container that the use of broad and narrow grooved matrix tapes allows proper fold lines to be produced to achieve desired folding characteristics in the final assembly. For example, the matrix tape utilized to form the fold lines between the bottom wall and side walls of the container are preferably relatively broad channeled to give the fold line greater flexibility and ease subsequent folding or pre-folding of the container. The fold lines coupling the side walls to the top walls as well as the bellows-type coupling members may be formed from a relatively narrow channeled matrix tape 162 to achieve crisp, flat folding for good sharp edges so as not to create bulges in the corner pocket sections of the assembled container. It should be recognized that for the various embodiments of the invention, a plurality of different matrix tapes may be utilized to achieve proper folding characteristics as desired.

Figure 10:
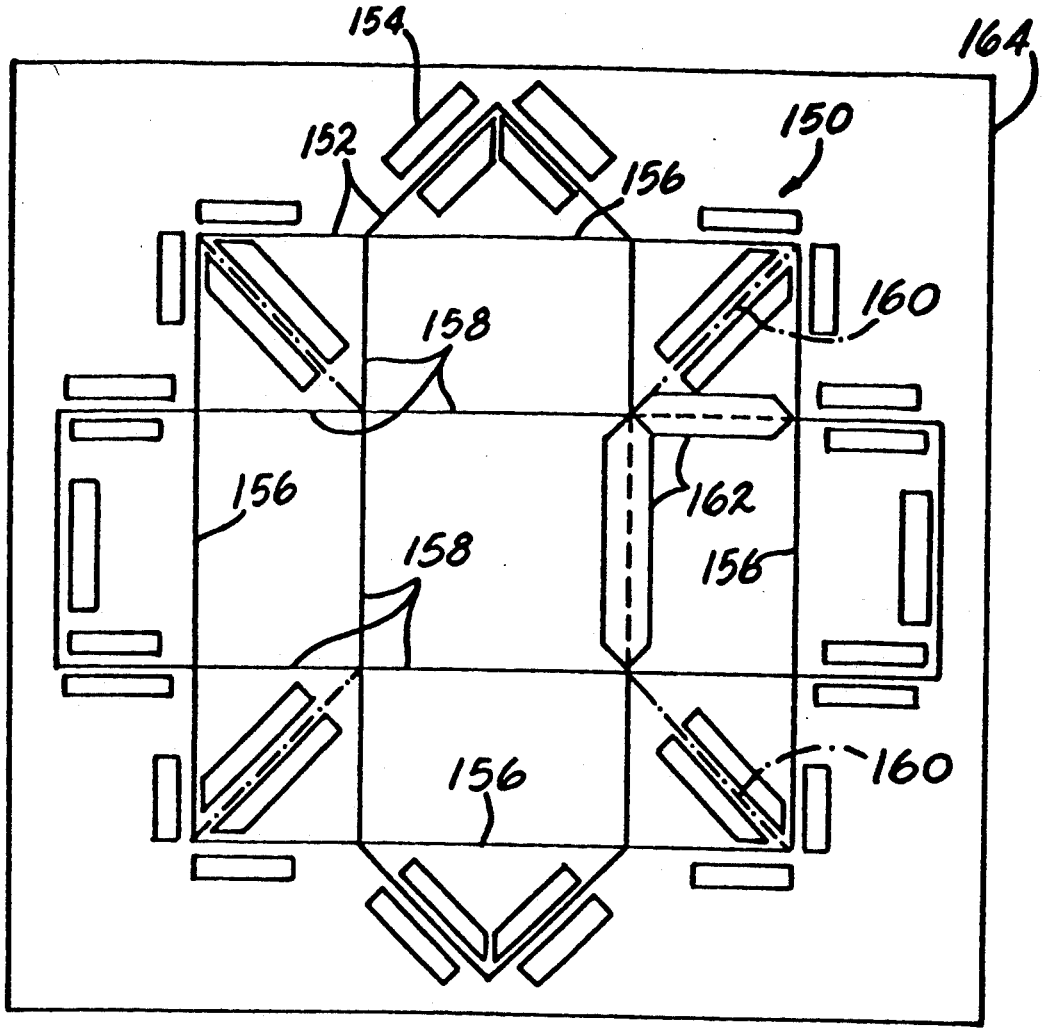
FIG. 10 is a top plan view of a die which may be used to form a foldable blank to construct the container.
Figure 11:
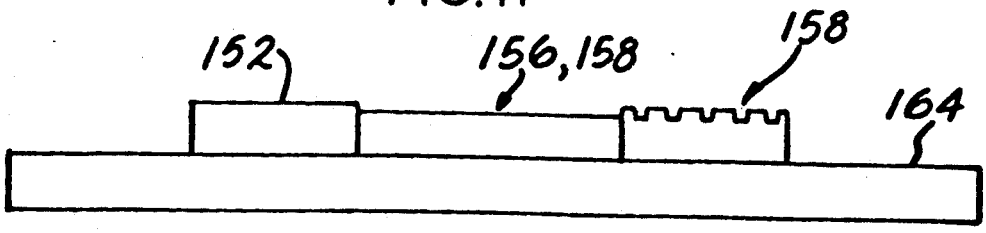
FIG. 11 is a side elevational view of the die as shown in FIG. 10.

In operation, the various slitting, scoring and perforal rules may be placed on a die chase or base portion 164 which is subsequently locked on the bed of a die press. In opposed relation to the chase is a platen (not shown)

to provide pressure against the rule members during manufacture. The matrix tape 162 is first placed upon the associated rules with which they are to be used as shown in FIG. 10, and subsequently the platen is brought into place such that the matrix tape is secured with the platen at the proper location relative to the various scoring rules. A sheet or web of material may then be drawn through the die assembly to form the foldable blanks as described. The die may be utilized on a cylinder or flat base and may comprise a plurality of nested dies to form a plurality of blanks during one manufacturing cycle.

The precision of the layout of the die members of die 150 is important to provide proper construction of the container and to allow proper registration of graphic material with respect to the fold lines formed therein. The fold lines produced in the container allow quick and easy folding of the container into its assembled position, and provides sharp and clean folds which yield an aesthetically pleasing appearance in the assembled container.

Although there has been illustrated and described what are preferred embodiments of the invention, it will be appreciated that numerous changes and modifications are likely to occur to those skilled in the art. For example, the fold lines may be constructed so as to allow the foldable blank to be folded reversibly such that different graphic material provided on alternate sides of the blank may be used as the outside of the container. Other changes or modifications will be apparent to those skilled in the art, and the invention is not limited by the disclosure but only as set forth in the appended claims.

We claim:

1. A container assembly which is constructed from a prefolded blank of material comprising;

a blank of material having fold lines formed therein which define a bottom wall, four side walls coupled to said bottom wall by means of said fold lines, bellows-type coupling members adapted to couple adjacent ones of said side walls to one another by means of said fold lines, and four top walls coupled to said side walls by means of said fold lines, wherein each of said bellows-type coupling members having fold lines formed therein which separate said bellows-type coupling members into at least two portions;

wherein said blank of material is prefolded to form a partially assembled container, said pre-folding comprising folding two opposed side walls, said bellows-type coupling members, and said top walls associated therewith onto said bottom wall by means of aid fold lines coupling said side and bottom walls, and folding the top walls associated with the remaining two side walls into a position adjacent said bottom wall, wherein said container assembly is constructed from said pre-folded blank by drawing said side walls to an upstanding position relative to said bottom wall, with said fold lines separating said bellows-type coupling members into at least two portions enabling said bellows-type coupling members to be inwardly folded to the interior of said container assembly, and said top walls being folded into substantially parallel relationship with said bottom wall.

2. A container assembly as in claim 1, wherein, said bellows-type coupling members which are prefolded along with their associated side walls are secured to the other side walls with which they are associated on one of said at least two portions thereof such that upon subsequent folding of the other of said side walls to an upstanding position relative to said bottom wall, the bellows-type coupling members will be automatically inwardly folded along the fold lines formed therein acting to draw up the side walls which were folded on to said bottom wall to their upstanding position relative to said bottom wall.

3. A container assembly as in claim 2, wherein, said one portion of said bellows-type coupling members which is secured to said side walls is the portion which lies directly adjacent said side walls to which said portions are secured.

4. A container assembly as in claim 2, wherein, said portions of said bellows-type coupling members are secured to said side walls by means of non-structural gluing thereof.

5. A container assembly as in claim 1, wherein, said fold lines coupling said top walls to said side walls are formed as hinged score lines to allow said top walls to be easily manipulated in both directions relative to said side walls.

6. A container assembly as in claim 1, wherein, said fold lines formed in said bellows-type coupling means are more easily manipulated than the fold lines coupling said side walls to said bottom wall, the fold lines coupling said top walls to said side walls and the fold lines coupling said side walls to said bellows-type coupling members.

7. A container assembly of claim 1, wherein the fold lines coupling said side walls to said bottom wall are score lines forming weakened zones, wherein said score lines are relatively broad to allow said side walls to be folded onto said bottom wall without damaging the blank of material from which the container is formed, and the fold lines coupling said side walls to said bellows-type coupling members are relatively narrow such that when folded they will form a sharp creased fold which will allow each of said side walls to be positioned in closely adjacent relationship when in their upstanding positions relative to said bottom wall.

8. A container assembly as in claim 1, wherein, at least two of said top walls which are diametrically opposed are dimensioned so as to slightly overlap when in their substantially parallel position relative to said bottom wall to allow said at least two top walls to be secured to one another.

9. The container assembly of claim 8, wherein, said at least two overlapping top walls are secured to one another by means of an adhesive material associated with one of said overlapping top walls.

10. The container assembly of claim 8, wherein, said at least two of said top walls which are diametrically opposed and adapted to be secured to one another are free from direct connection to one another and are secured to one another by means of a separate securing means.

11. The container assembly of claim 1, wherein, two of said top walls are formed in rectilinear configuration, with the other two of said top walls being formed in triangular configuration, wherein said rectilinear top walls are initially folded into said substantially parallel relationship with said bottom wall and subsequently said triangular top walls are folded to said substantially parallel relationship with respect to said bottom wall, wherein each of said top walls will then be exposed at approximately the center of the enclosed top of the container formed by the top walls, wherein a securing means may be positioned at this center location to secure each of the top walls thereto.

12. The container assembly of claim 11, wherein, said rectilinear top walls are angled at their outer edges at a pre-selected angle which coincides with the angle of the triangularly shaped top walls such that a plurality of said blanks of material may be interlocked along a portion of each of said plurality constituting part of said triangularly shaped top wall and an adjacent bellows-type coupling member of a first blank, a bellows-type coupling member and a portion of a rectilinear top wall of a second blank.

13. The container assembly of claim 12, wherein, a plurality of said blanks of material are formed from a single unitary sheet of material, wherein said interlocking relationship of said plurality of blanks allows said plurality of blanks to be oriented with respect to said sheet so as to minimize the production of scrap material therefrom.

14. The container assembly of claim 1, wherein, said blank of material also has formed therein at least one punch-out portion which may be subsequently removed from the blank of material.

15. The container assembly of claim 1, wherein, said blank of material includes at least one slot formed therein which is adapted to accept and retain a separate gift card.

* * * * *